US011913228B2

(12) United States Patent
Edwards et al.

(10) Patent No.: US 11,913,228 B2
(45) Date of Patent: Feb. 27, 2024

(54) BUILDING PANEL ASSEMBLY AND METHOD OF MANUFACTURING

(71) Applicant: 4Wall IP Ltd., Mahe (SC)

(72) Inventors: Nicholas Edwards, Mahe (SC); Christopher Moss, Mahe (SC)

(73) Assignee: 4WALL IP DMCC, Dubai (AE)

( * ) Notice: Subject to any disclaimer, the term of this patent is extended or adjusted under 35 U.S.C. 154(b) by 0 days.

(21) Appl. No.: 17/293,945

(22) PCT Filed: Nov. 15, 2019

(86) PCT No.: PCT/GB2019/053243
§ 371 (c)(1),
(2) Date: May 14, 2021

(87) PCT Pub. No.: WO2020/099887
PCT Pub. Date: May 22, 2020

(65) Prior Publication Data

US 2022/0010556 A1 Jan. 13, 2022

(30) Foreign Application Priority Data

Nov. 16, 2018 (GB) ..... 1818717

(51) Int. Cl.
*E04C 2/296* (2006.01)
*E04C 2/38* (2006.01)
*E04C 2/34* (2006.01)

(52) U.S. Cl.
CPC ..... *E04C 2/296* (2013.01); *E04C 2/38* (2013.01); *E04C 2002/3488* (2013.01)

(58) Field of Classification Search
USPC ..... 52/309.4, 309.7, 309.15
See application file for complete search history.

(56) References Cited

U.S. PATENT DOCUMENTS 3,686,815 A * 8/1972 Von Bose ..... E04B 1/383 52/27
6,253,530 B1 * 7/2001 Price ..... E04B 1/12 428/116
2007/0130866 A1 * 6/2007 Lott ..... E04C 2/246 52/481.1
2009/0113820 A1 * 5/2009 Deans ..... E04B 1/14 52/800.1

(Continued)

FOREIGN PATENT DOCUMENTS

GB 2450994 A * 1/2009 ..... B29C 44/1233
GB 2450994 A 1/2009

(Continued)

OTHER PUBLICATIONS

International Search Report filed in PCT/GB2019/053243, dated Feb. 7, 2020; 4 pages.

*Primary Examiner* — Joshua K Ihezie
(74) *Attorney, Agent, or Firm* — Vedder Price P.C.

(57) ABSTRACT

Building panel assemblies for use in the construction of new homes, commercial buildings and extensions having rectangular structural insulated panel (SIP) (10), comprises a pair of spaced-apart containment boards (12',12") an inner insulating core (13) and a low profile peripheral external rigid frame (14), preferably of metal, e.g. steel, extending around the entire periphery of the spaced-apart boards (12',12").

11 Claims, 9 Drawing Sheets

(56) References Cited

U.S. PATENT DOCUMENTS

| | | | | |
|---|---|---|---|---|
| 2012/0247046 | A1 | 10/2012 | Jewett et al. | |
| 2013/0104480 | A1 | 5/2013 | Smith | |
| 2013/0316134 | A1* | 11/2013 | Anderson | B32B 5/20 29/897.32 |
| 2019/0242127 | A1* | 8/2019 | Kreizinger | E04B 2/707 |
| 2020/0217067 | A1* | 7/2020 | Rosan | E04B 2/721 |

FOREIGN PATENT DOCUMENTS

| | | | | |
|---|---|---|---|---|
| GB | 2451275 | A * | 1/2009 | E04B 1/14 |
| WO | 2001026899 | A1 | 4/2001 | |
| WO | 2006086228 | A2 | 8/2006 | |
| WO | 2014081486 | A1 | 5/2014 | |
| WO | 2015107369 | A1 | 7/2015 | |

* cited by examiner

FIG, 6

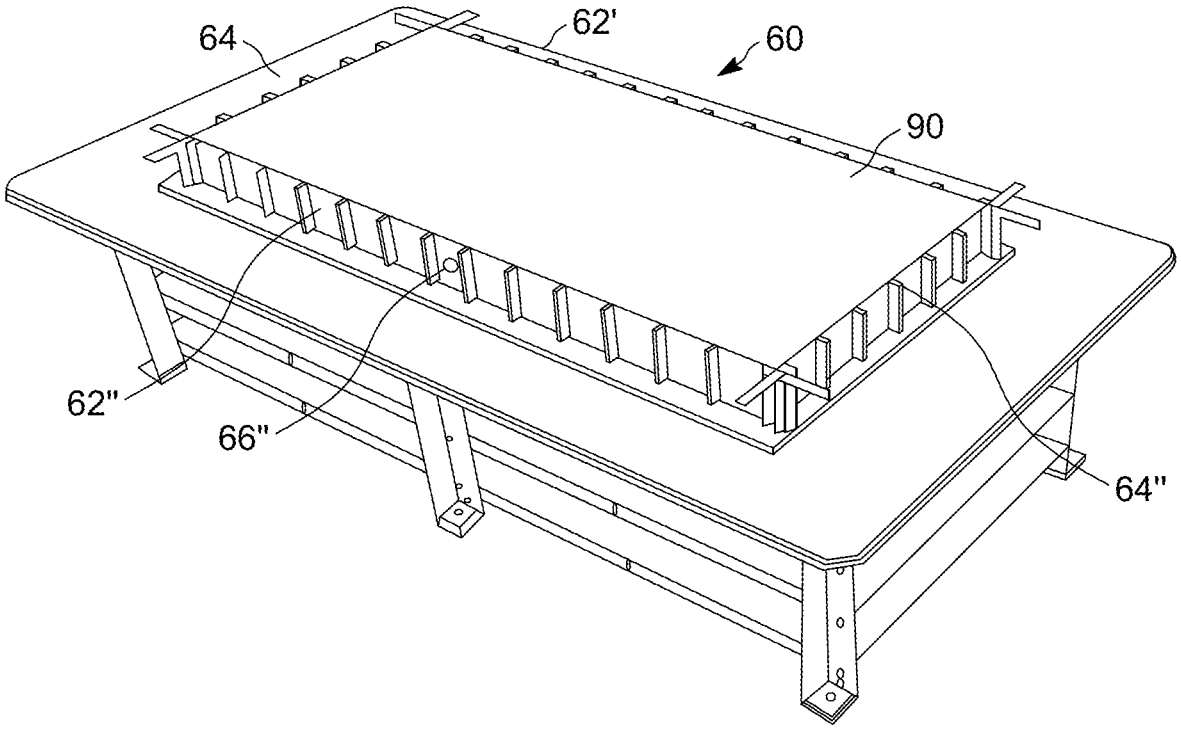
FIG, 9

BUILDING PANEL ASSEMBLY AND METHOD OF MANUFACTURING

The present invention relates to a building panel assembly for use in the construction of new homes, commercial buildings and extensions of one or more storeys. The assemblies of the present invention may be factory fabricated and deemed as 'Offsite' construction under a wider acronym of MMC (modern methods of construction).

There are a number of Offsite methods known in the art include timber frame panel assemblies which are factory fabricated to various degrees of completion prior to being delivered to site and SIPS (structurally insulated paneling systems) which comprises a glued or foamed structural insulation core between two sheathing boards separated by the insulation which provides structural racking resistance to the walling panel as well as an internal and external wall face. Whilst there are many examples of each of the above Offsite paneling system types, they have not been specifically designed and developed to provide a building system solution which can be used in extremes of weather, temperature, humidity and wind whilst ensuring the structure is not susceptible to infestation or being eaten (Termites).

The primary design elements for any building are well understood as they have to provide shelter, warmth, coolth, protection and security whilst being comfortable to live in. These design elements are universal and 'local buildings' have a mix of the above attributes depending upon their historical and often 'empirical' design. In the most part, buildings have been built using locally available materials and formed into structures to provide some or all of the desired functional aspects described above.

As the world's governments commit to reducing the impacts of climate change, the adoption of new approaches to deliver more sustainable buildings and structures has to be enforced by adopting strict building performance codes which ensure the buildings are energy efficient and sustainable. The energy efficiency of a building envelope is a mixture of insulation and airtightness which serves both to keep heat in or out (depending upon climate conditions) and prevent draughts into or out of the building which increases the demand for energy usage to compensate.

Known fabricated building panels typically include a mixture of insulation and membranes (internally and externally) to provide moisture control and airtightness these materials usually rely upon the introduction of sticky tapes and mastic or silicone seals to aid their performance which can fail over time or extremes in weather and be subject to poor installation techniques leading to poor performance. In addition, often these buildings are constructed by poorly trained (or poorly supervised) builders, which means the 'designed performance' is never met during the life of the building even at the outset.

Advantageously, the present invention addresses one or more of the problems associated with the prior art.

According to the present invention there is provided a building panel assembly comprising a pair of spaced-apart containment boards, separated by an inner insulating core, said inner insulating core comprising one or more bodies around which a curable insulating foam may be introduced.

The spaced apart containment boards may form a void therebetween for receiving the one or more bodies. A curable insulating foam may then be introduced between the containment boards and at least partially around the one or more bodies. The structural integrity may be increased owing to the presence of the one or more bodies and/or the manufacturing efficiency may be increased owing to, for example, shorter and/or more cost effective cure times.

The present invention may utilise standard and well known building materials (in the most part) as used in other Offsite system (described above) but only materials which can fulfil their design function within the design brief of being used in diverse weather climates without major redesign are used, therefore materials such as non-treated timber, OSB (orientated strand board) and some externally applied breather membranes have not been used.

The Applicants have taken into account the weaknesses of existing offsite paneling systems both in the material selection and the necessary skills of the builders to construct a building which performs optimally without the need for applying additional membranes, tapes, vapour control layers (VCLs) and mastics in order to provide the moisture and airtightness necessary in a high performance energy efficient building envelope.

The present invention has been designed to satisfy additional performance requirements being placed upon it driven by a need for a 'worldwide' solution with variant 'country' orientated preferences (such as concrete floors, acoustic walls and the ability of the structure to carry additional loadings without the introduction of additional internal structural elements such as columns). The present invention may be capable of carrying additional loading (over and above that provided by standard SIPS panels or timber frame panels without the need for additional structure) and/or be capable of being substantially 'airtight' as a natural part of the panel assembly without the need for tapes, membranes and sealants during or after the erection of the panels.

The present invention may utilise a lightweight structural steel frame around the periphery of each panel which has been shaped such to provide both an airtight seal (via 'Z' joints or air torture routes) and a structurally stiff 'I' joint at each panel to panel connection. This joint may have a spigot of MgO board glued into each spline (2 splines, spigots or tongues per joint) which serves as an additional airtight connector, joins the panels together and provides a line load (vertical column) at each panel joint which increases the load bearing capacity of the standard panels to cope with carrying increased UDL's or point loads and may be able to carry precast concrete floors. Where additional support is required within the wall depth, the MgO splines, spigots or tongues may be replaced with a structural steel column (UC) which fits into the shape between the two adjoining panels and provides additional line loads for individual point loads such as internal beam supports.

In an embodiment, the present invention's use of lightweight structural steel frame combined with a structural insulation and external and internal structural racking boards, combine to form a composite structure which can carry extreme wind/side loads and increased vertical loads whilst providing a robust and thermally efficient airtight structure. However, additionally the present invention avoids the need for additional elements to eliminate 'Thermal Bridging' as its construction is optimized to prevent thermal bridging at the panel joints by uniquely 'floating' the external racking boards on each face of the panel off the steelwork sections whilst maintaining a layer of insulation in front of each section of steelwork such that the steelwork does not compromise the thermal capacity of the panels at the junctions.

In an embodiment, the present invention's use of preformed lightweight steel sections 'both as vertical I joints and male and female' connectors, can help ensure that the panels are in perfect alignment due to the accuracy and 'straightness' of the soleplates unlike both timber frame and standard SIP's panels which are often not in alignment due to the fact that the fixing plates are treated timber which are often warped and not in alignment. The accuracy of the present invention's panel alignment can help ensure that each 'panel to panel' connection can be made whilst ensuring that the external and internal board faces do not 'step in or out' leading to problems with plastering/jointing/rendering or decoration.

The present invention minimizes any thermal bridging by ensuring that the rigid frame is insulated from the containment boards by the inner insulating core.

The frame may define a pair of spaced-apart longitudinal channels, which extend around the periphery of the panel and extend into the space between the spaced-apart pair of containment boards.

The rigid frame preferably comprises one or more splines, spigots or tongues complimentarily shaped to the channel and received thereby. Two or more panels may thus be connected to one another and slot into place. More preferably, the rigid frame comprises two splines, spigots or tongues.

The panel may comprise at least one conduit disposed adjacent to and between the containment board and the inner insulating core. The location of the conduit, for cabling and the like, reduces thermal bridging and ensures that there is insignificant loss of thermal insulating core material between containment boards.

In an embodiment, there are two conduits one disposed adjacent to each of the containment boards. In this embodiment, which may be used for an interior wall structure in a building, cabling can run either side of the panel and can be easily accessed by, for example, an electrician for positioning an electrical power socket, light switch or any such electrical terminal.

The present invention allows maximum 'Offsite' processes to produce the core system—less reliance on vagaries of labour, weather, site storage and wastage and can work with existing 'entrenched' non-regulatory building materials or trades, such as bricks, blocks and concrete.

Site conditions vary as does the ability to utilise heavy machinery such as cranes, therefore, the system preferably is supplyable to a site in both 'large and small' format panels to suit the project whilst neither of which could restrict the flow and efficiency of the production process. In one embodiment, short lead times (with reduced costs and higher quality) require a 'pre-processed' level of constructed panels available as 'stock items' which can go directly to site or be factory assembled into required wall elevations.

The assembly of the present invention preferably has improved rigidity, structural integrity and improved load-bearing capacity, and in particular has improved resistance to twisting and moreover, improved thermal insulating properties.

When assembling a structure utilising panels according to the present invention, in one embodiment, a horizontal sole plate would first be secured to the foundations of the structure, such sole plate having a pair of parallel upstanding rails which are received into the parallel spaced apart-channels of the frame on the base of the SIP wall panel. For vertical alignment, a vertical sole plate would be provided perpendicularly disposed with respect to the horizontal sole plate, again having corresponding rails for engagement into the spaced-apart channels on the adjacent vertical edge of the SIP panel, thereby enabling accurate positioning a first panel, having previously accurately located the horizontal and vertical sole plates. A subsequent SIP panel is then positioned on the sole plate and connected to said first panel using alignment tracks, and the process is continued until the length of a wall is reached, which can be terminated with a vertical sole plate. As the horizontal sole plate and the vertical soleplates have been constructed such that they are perpendicular to one another, the panels are consequently square to one another and correct alignment is ensured. In order to secure the top edge of the respective panels, a lintel, of similar construction to the wall panels, can then be positioned extending across the top of a plurality of wall panels, said lintel also having corresponding spaced-apart channels in the peripheral frame for receiving corresponding alignment tracks and for engaging with corresponding tracks of respective wall panels and corner posts.

An advantage of the provision of a rigid peripheral frame according to the present invention is that such can be utilised with more fragile panel members, including magnesium oxide panels, which provide a fire proofing element if required. The rigid structure of the peripheral frame, and its resistance to bending or twisting, significantly improves the performance and protection of more friable materials.

Whilst the panels would generally be made to a standard dimension, smaller, narrower, or reduced height panels can be provided to enable the provisions of openings for doors and windows wherever appropriate within the overall construction of a structure.

Further, a significant benefit is the ability to provide conduits through the panels to enable the supply of services, e.g. electrical wiring through the panels without significantly effecting the integrity of such panels, as set out hereinabove.

The panel frame may have an aperture to permit the flow of curable insulating material therethrough.

The one or more solid bodies may account for 95% or less of the internal volume of the cavity between containment boards. Advantageously, the one or more solid bodies account for 90% or less, 80% or less, 70% or less, 60% or less, 50% or less, 40% or less, 30% or less or 20% or less of the internal volume of the cavity. In an embodiment, the one or more solid bodies account for 25-50% of the internal volume of the cavity between containment boards. In an embodiment, the one or more solid bodies may account for 30% of the internal volume of the cavity between containment boards.

The curable insulating material may account for the remaining volume of the cavity.

The curable insulating material may be cured by any suitable means. Advantageously, the curable insulating material may be heat and/or UV cured.

The present invention will now be described, by way of example only, with reference to the accompanying drawings and examples, in which:

FIG. 9 shows an assembled panel contained within the jig for further processing.

Figure 1:
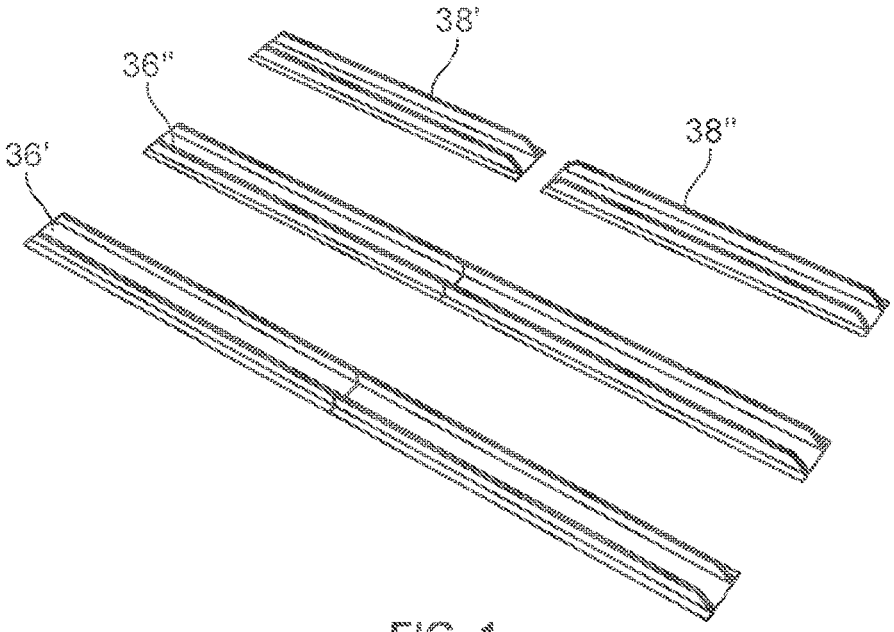
FIGS. 1 to 5 shows the components and assembly of a panel frame according to the present invention.
Figure 2:
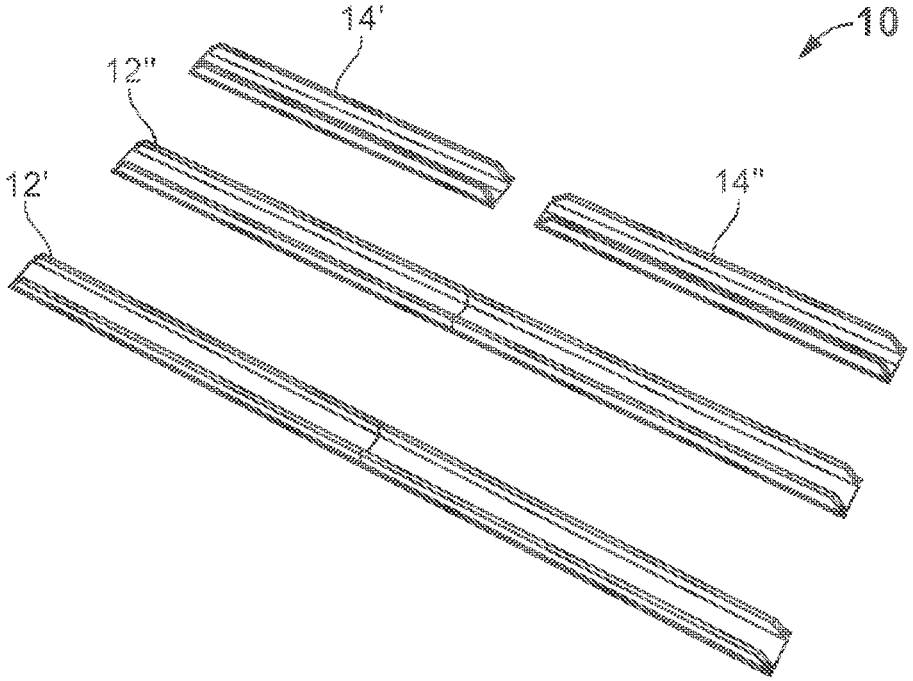
Figure 3:
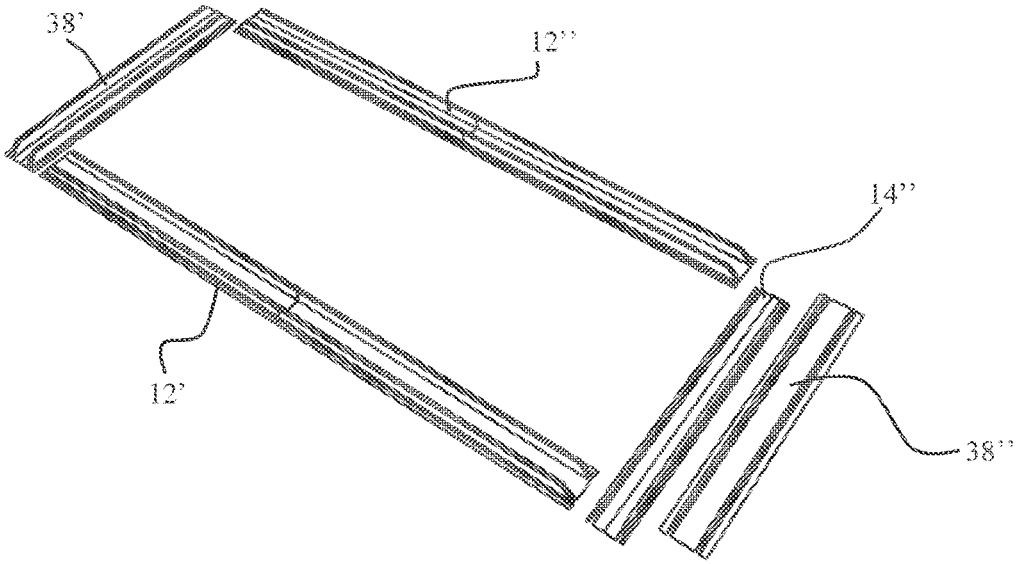
Figure 4:
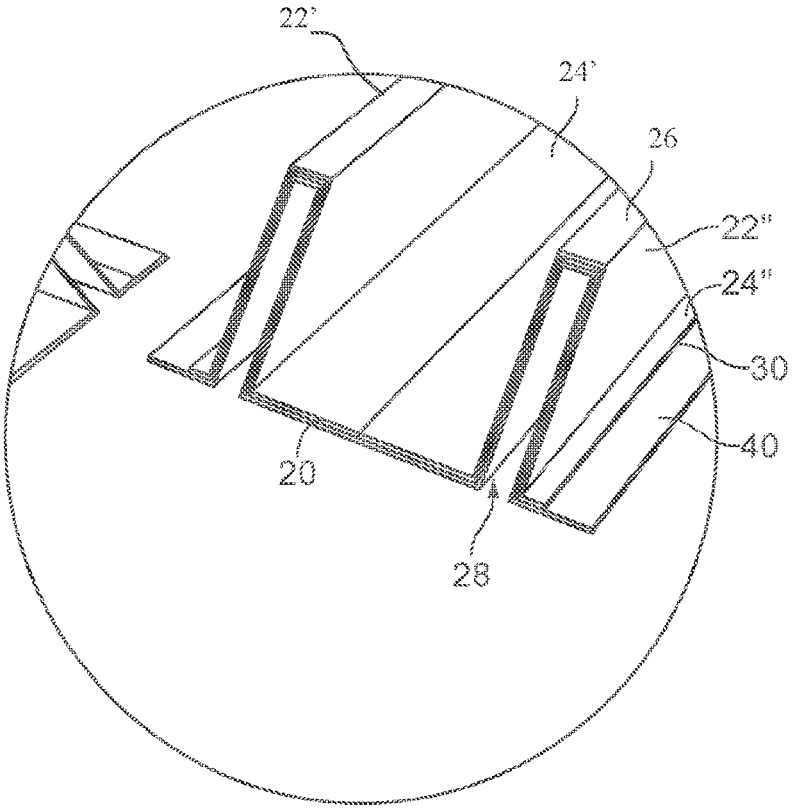

FIGS. 1 to 5 show the assembly of a steel frame for a panel 10 having two elongate side members 12', 12" and shorter elongate first 14' and second 14" end members.

Each member comprises a planar base 20 from which two upstanding walls 22', 22" extend perpendicularly thereto and which extend along the entire length of the member.

Each upstanding walls 22', 22" comprise two side walls 24', 24" which extend perpendicularly with respect to the plane of the base and an end wall 26 therebetween parallel to the plane of the base, forming a channel 28 running the length of the member.

The longitudinal edge of the member has a flange 30 extending perpendicularly to the plane of the side wall and extending along the member's longitudinal length.

The panel frame members sit over and are complementarily shaped to casket frame members 36', 36", 38', 38" which support the panel frame members during manufacture. The flange 40 of the casket steel extends beyond the flange 30 of the panel steel.

The ends of each member are mitred to permit assembly of a rectangular frame having two perimetral channels extending around the outer surface of the frame and two walls extending into the interior of the frame around the inner surface of the frame.

When all of the sections have been interlocked, the junction between casket and frame members is sealed with masking tape to prevent PU foam entering the joint during foaming thus minimising cleaning afterwards.

Figure 5:
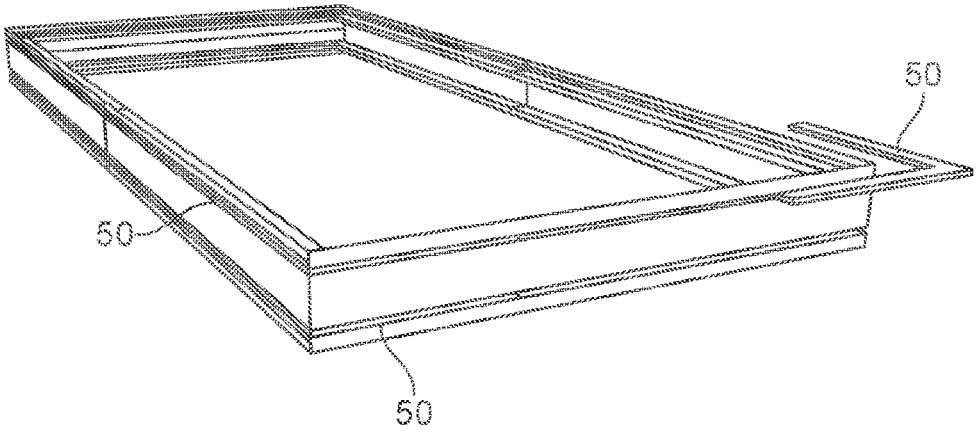

FIG. 5 shows the use of right angled square member 50 that is received by the circumferential channels at their corners to provide structural integrity whilst a panel is being manufactured and to prevent the casket and panel steel from moving, locking the members together to facilitate easier handling.

The assembly can then be inserted into a rectangular jig 60 for further processing.

Figure 6:
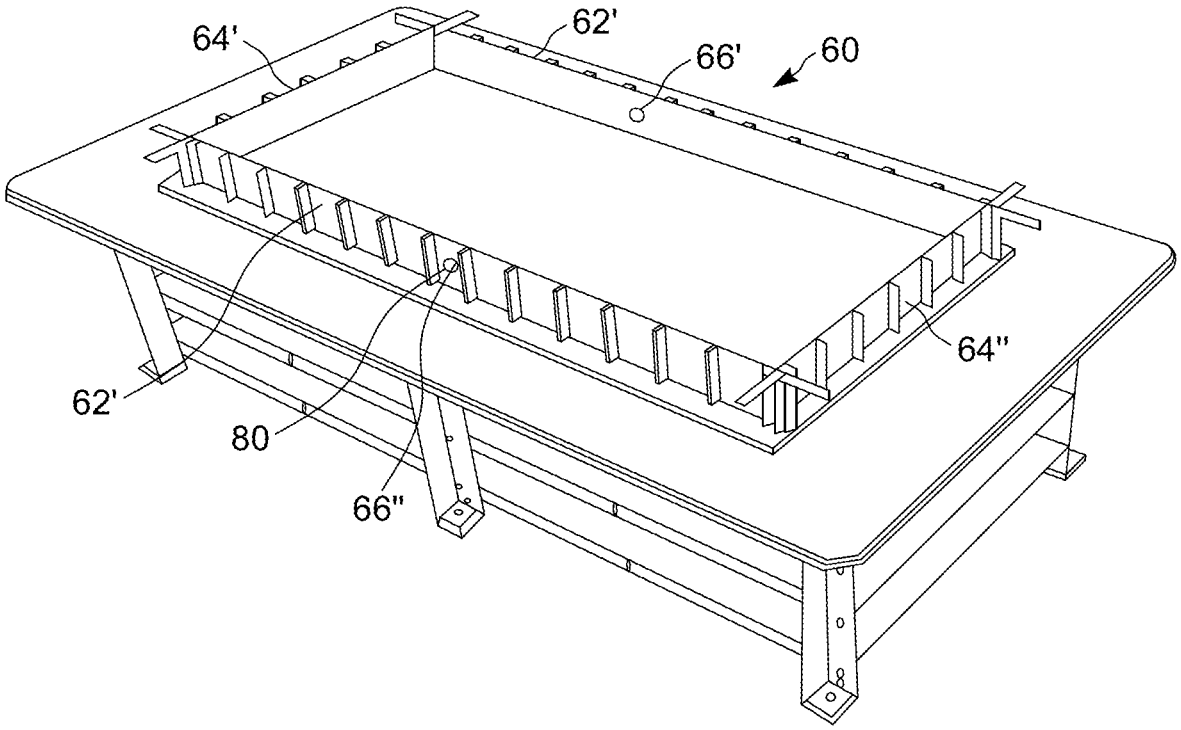
FIG. 6 shows a jig for use in the manufacture of a panel in accordance with the present invention.

FIG. 6 shows the assembly of the jig 60 for receiving the assembled panel and casket frames. Similarly, it has two elongate side walls 62', 62" and two shorter end walls 64', 64" to form a rectangular jig complementarily shaped to receive the panel and casket assembly.

The assembly is lowered into the jig 60 which has a centrally disposed aperture 66', 66" in the side walls through which a conduit may pass to deliver fluidised PU foam.

Figure 7:
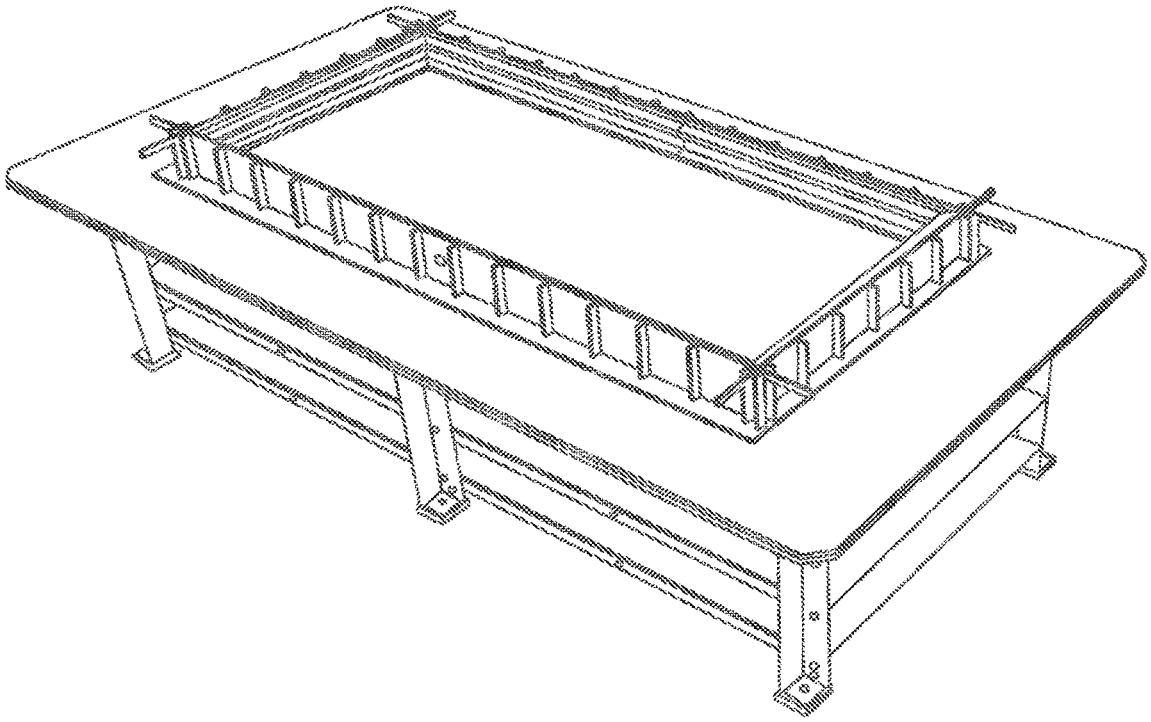
FIG. 7 shows the jig with panel and casket frames placed therein.

FIG. 7 shows the jig of FIG. 6 with panel and casket frame members placed therein.

Figure 8:
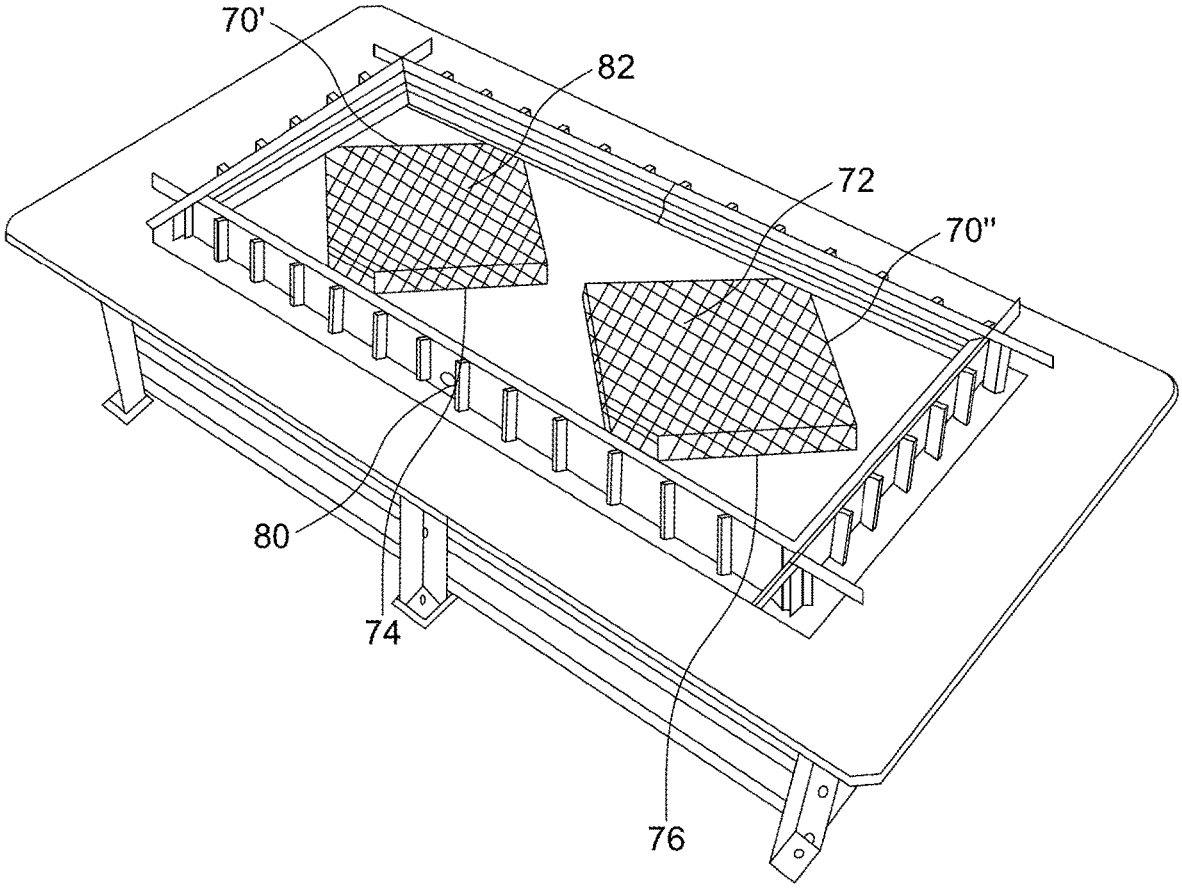
FIG. 8 shows the jig and frames having preformed bodies.

FIG. 8 shows two lozenge-shaped preformed bodies 70', 70" placed within the interior of the jig 60. The bodies are arranged in series and fill a significant portion of the interior volume of the space between frame members.

Each lozenge 70', 70" has a rectangular cross section, and has an upper 72 and lower 74 surface and a perimetral side wall 76. Extending over the upper and lower surface of the lozenge are spacer members consisting of spikes which space the lozenge away from the interior faces of the containment boards. This permits the foamed PU when injected to surround the lozenge and help adhere it to the integral structure of the containment boards and foamed PU. Without the spacer members, the upper or lower surface of the lozenge would rest on the interior surface of the containment board and would be unlikely to adhere thereto, compromising the structural integrity of the finalised panel.

FIG. 9 shows the assembly of FIG. 8 having a second containment board 90 placed on top of the frame members and over the lozenges, sandwiching them between first and second containment boards. The assembly can then be further processed by introducing PU foam into the sandwich construction via aperture 66' and/or 66" and subsequently curing the foamed PU to form the panel.

The invention claimed is:

1. A building panel assembly comprising a pair of spaced-apart containment boards, separated by an inner insulating core, said inner insulating core comprising one or more preformed body around which a curable insulating foam is introduced;

at least one peripherally disposed channel for receiving a rigid frame, said channel spaced apart from and disposed between the containment boards;

wherein the rigid frame defining a pair of spaced-apart longitudinal channels extending around the periphery of the panel and into the space between the spaced-apart part of containment boards;

at least one conduit disposed adjacent to and between at least one containment board and the inner insulating core; and wherein each preformed body comprised a plurality of alignment members disposed in order to maintain its position away from the at least one containment board.

2. A building panel assembly as claimed in claim 1 wherein the alignment members comprise one or more protrusions extending from the surface of the preformed body.

3. A building panel assembly as claimed in claim 1 having two conduits.

4. A building panel assembly as claimed in claim 1, in which the containment boards are selected from oriented strand board, cement particle board magnesium oxide wall board, plywood, pressure treated plywood, steel, aluminium, fibre reinforced plastics, or metal, or composite sheeting.

5. A building panel assembly as claimed in claim 1, in which the inner insulating core is comprised of expanded polystyrene foam, extruded polystyrene foam or polyurethane foam.

6. A building panel assembly as claimed in claim 1 wherein the one or more preformed body is solid.

7. A building panel assembly as claimed in claim 1 wherein the one or more preformed body accounts for 95% or less of an internal volume of the cavity between the containment boards.

8. A building panel assembly as claimed in claim 7 wherein the one or more preformed body accounts for 25-50% of the internal volume of the cavity between the containment boards.

9. A building panel assembly as claimed in claim 8 wherein the one or more preformed body accounts for 30% of the internal volume of the cavity between the containment boards.

10. A building panel assembly as claimed in claim 1 wherein the curable insulating foam accounts for h remaining volume of the inner insulating core.

11. A building panel assembly as claimed in claim 1 wherein the curable insulating foam is heat and/or UV cured.

* * * * *